US006398016B1

(12) United States Patent
Maeder et al.

(10) Patent No.: US 6,398,016 B1
(45) Date of Patent: Jun. 4, 2002

(54) CONVEYOR DEVICE

(75) Inventors: Carl Conrad Maeder; Jürg Eberle, both of Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/582,504

(22) PCT Filed: Dec. 9, 1998

(86) PCT No.: PCT/CH98/00526

§ 371 (c)(1),
(2), (4) Date: Jun. 22, 2000

(87) PCT Pub. No.: WO99/33732

PCT Pub. Date: Jul. 8, 1999

(30) Foreign Application Priority Data

Dec. 23, 1997 (CH) ..... 2965/97

(51) Int. Cl.[7] ..... B65G 29/00
(52) U.S. Cl. ..... 198/867.13; 198/805
(58) Field of Search ..... 198/803.01, 805, 198/465.1, 465.4, 461, 867.13, 867.04

(56) References Cited

U.S. PATENT DOCUMENTS 4,007,824 A 2/1977 Reist ..... 198/462
4,892,186 A 1/1990 Frei
5,261,520 A 11/1993 Duke ..... 198/375

FOREIGN PATENT DOCUMENTS

EP 0043399 1/1982
FR 2 342 918 9/1977

OTHER PUBLICATIONS

European Search Report and Annex for Swiss Application No. Ch 296297, Dec. 23, 1997.

*Primary Examiner*—Kenneth W. Noland
(74) *Attorney, Agent, or Firm*—Brinks Hofer Gilson & Lione

(57) ABSTRACT

A conveyor device comprising a guiding rail for guiding at least one transport mechanism. A ferromagnetic guide, including a magnet, is fixed to the guiding rail. An article carrying part is detachably connected to the transport mechanism through a magnetic circuit that flows through two spaced apart ferromagnetic guide parts carried by the transport mechanism. The ferromagnetic guide and the ferromagnetic guide parts are located relative to each other such that there is an air gap there between through which the magnetic circuit flows to create an attractive force, Fm, holding the article carrying part on the transport mechanism.

14 Claims, 5 Drawing Sheets

CONVEYOR DEVICE

This application claims priority under PCT Application PCT/CH98/00526 that was filed on Dec. 9, 1998. PCT Application PCT/CH98/00526 claims priority under Switzerland Application No. 1997 2965/97 that was filed on Dec. 23, 1997.

The invention relates to a conveyor device according to the precharacterizing clause of claim 1.

A conveyor device comprising a guide rail and transport means guided on the guide rail and driven in a conveying direction is known from patent specification CH 382 768. This known conveyor device makes it possible to grasp printing products, convey them along the rail and deposit them at a distant location.

One disadvantage of this known device is the fact that the conveying means are at a relatively long distance from one another, and the printing products can therefore be conveyed only with a low density. Moreover, the conveying means, which in each case comprise a conveying carriage and a holding means, are connected fixedly to one another and are made relatively large.

An object of the invention is to develop a conveyor device in such a way that the transport means arranged on a guide rail can convey a product stream with high flexibility and high density.

This object is achieved by means of a conveyor device having the features of claim 1. Claims 2 to 12 relate to further advantageous embodiment [sic] of the conveyor device. The object is also achieved by means of a conveyor system having the features of claim 13 and by means of a guide rail designed in adaptation to the conveyor device and having the features of claim 14.

The object is achieved, in particular, by means of a conveyor device comprising a guide rail and at least one transport means guided on the guide rail and driven in a conveying direction, a ferromagnetic flux-conducting member arranged fixedly relative to the guide rail comprising a magnet, and the transport means having in each case two ferromagnetic flux-conducting parts which are located at a distance from one another and are designed and arranged in such a way that, on the one hand, a magnetic circuit is formed between a ferromagnetic article part bearing releasably on the transport means, and in such a way that, on the other hand, the flux-conducting parts and the flux-conducting member are arranged in adaptation to one another, at the same time forming an air gap, in such a way that the two flux-conducting parts form with the flux-conducting member a magnetic circuit for exerting a magnetically generated attractive force on the article part.

The conveyor device comprises a guide rail with a plurality of transport means guided on the guide rail. These transport means have, in a preferred embodiment, a load side on which an article to be transported can be mounted or onto which an article to be transported can be deposited. Each transport means comprises a plurality of sliding or rolling means which are designed, in particular, as a pin or as a wheel engaging, for example, into oppositely arranged V-shaped grooves of a guide rail, so that the transport means is guided by the guide rail in a conveying direction. The transport means has two ferromagnetic flux-conducting parts which are arranged at a distance from one another and which at one end open out on the load side and at their other end are arranged in alignment with a ferromagnetic flux-conducting member, at the same time forming an air gap. This flux-conducting member comprises a magnet which is designed, for example, as a permanent magnet. The magnet, the flux-conducting members and the flux-conducting parts thus form a magnetic circuit. When a ferromagnetic article part is laid onto the load side, it is attracted by the transport means as a result of the magnetically generated attractive force and is thereby held on the transport means.

The conveyor device according to the invention thus makes it possible for an article to be transported or a ferromagnetic article part to be connected to the transport means or else separated from the transport means in an activatable manner via magnetically acting forces. The article to be transported may rest directly on the transport means. There is also the possibility, however, of arranging on the ferromagnetic article part a further means suitable for transporting an article, for example a carrying part arranged above the article part or a holding means suspended from the article part.

The ferromagnetic flux-conducting member, which, in a preferred embodiment, is arranged so as to extend on both sides of a guide rail, may extend in the conveying direction of the guide rail over a relatively long portion or over the entire length of the guide rail. A ferromagnetic flux-conducting member designed in this way has a plurality of magnets arranged at a distance from one another in the conveying direction, so that the magnetic circuit has at every point a sufficiently high magnetic flux to hold the article part securely on the transport means. A magnetic flux is thus generated at every point on a transport means moving along the guide rail in a conveying direction, so that the article part, which bears on the load side of the transport means, constantly experiences an attractive magnetic force.

The magnets may also be designed as electromagnets, the electromagnet consisting at least of a coil wound around the flux-conducting member. The advadtage of an electromagnet is that the magnitude of the magnetic flux and therefore the magnitude of the magnetically generated attractive force can be controlled. A ferromagnetic flux-conducting member may also comprise a permanent magnet and an electromagnet, the electromagnet being capable of being controlled in such a way that the permanent magnet and the electromagnet either generate in each case mutually intensifying magnetic fluxes running in the same direction or generate in each case mutually reducing magnetic fluxes running in opposite directions.

The conveyor device according to the invention is suitable, in particular, for the conveyance of printing products. The article part may be designed, for example, as a rail-guideable conveying means, as disclosed in U.S. pending application Ser. No. 09/555,319, filed on May 22, 2000 which is based upon CH patent application No. 1997 2962/97 of the same applicant, filed on the same day and entitled "Rail-guideable conveying means and guide rail for guiding the conveying means". Further embodiments and applications of the conveyor device according to the invention are disclosed in U.S. pending applications Ser. Nos. 09/554,546 and 09/554,539 both filed on May 12, 2000 and which are based upon CH patent applications Nos. 1997 2963/97 and 1997 2964/97 of the same applicant, filed on the same day and entitled "Conveyor system" and "Conveyor device and corresponding transport means".

The invention is explained below by means of exemplary embodiments with- reference to the drawings of the figures.

Figure 5A:
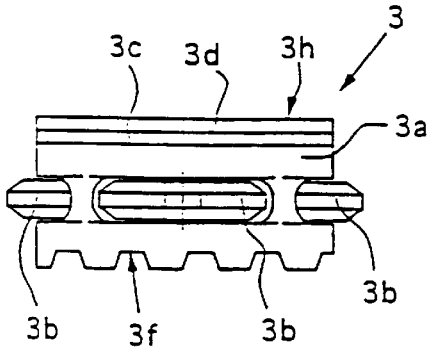
Figure 9:
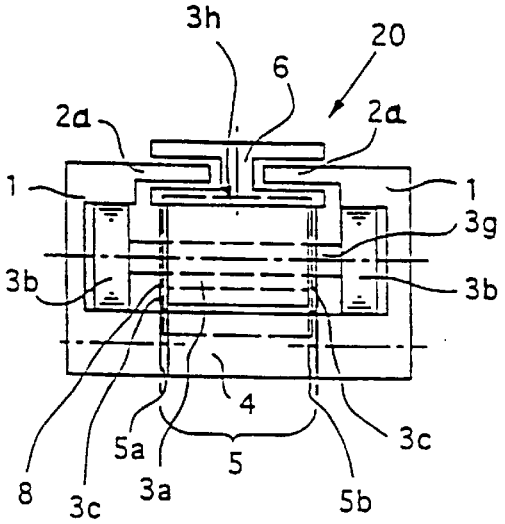
Figure 5B:
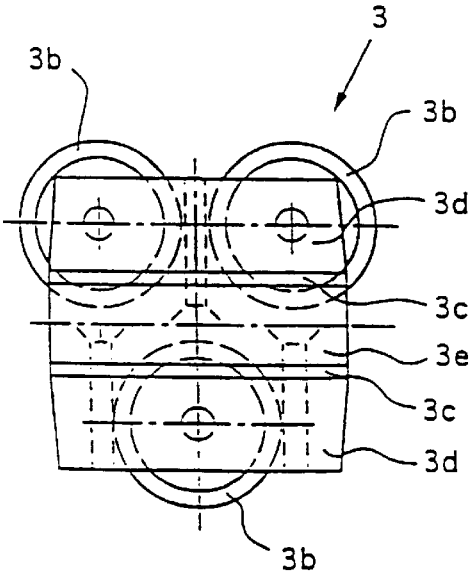
Figure 6:
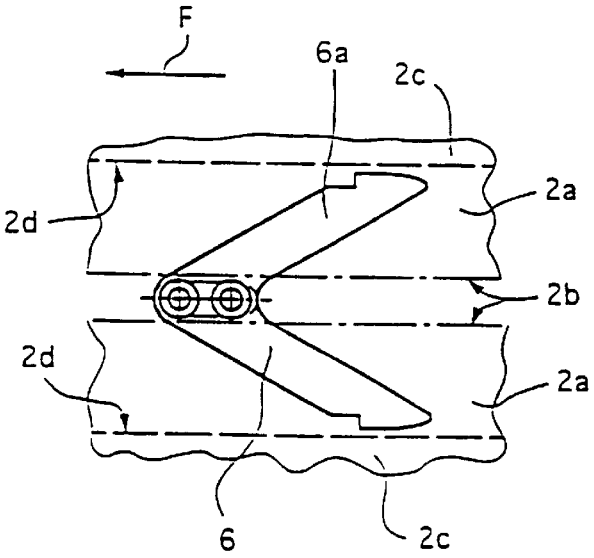
Figure 7:
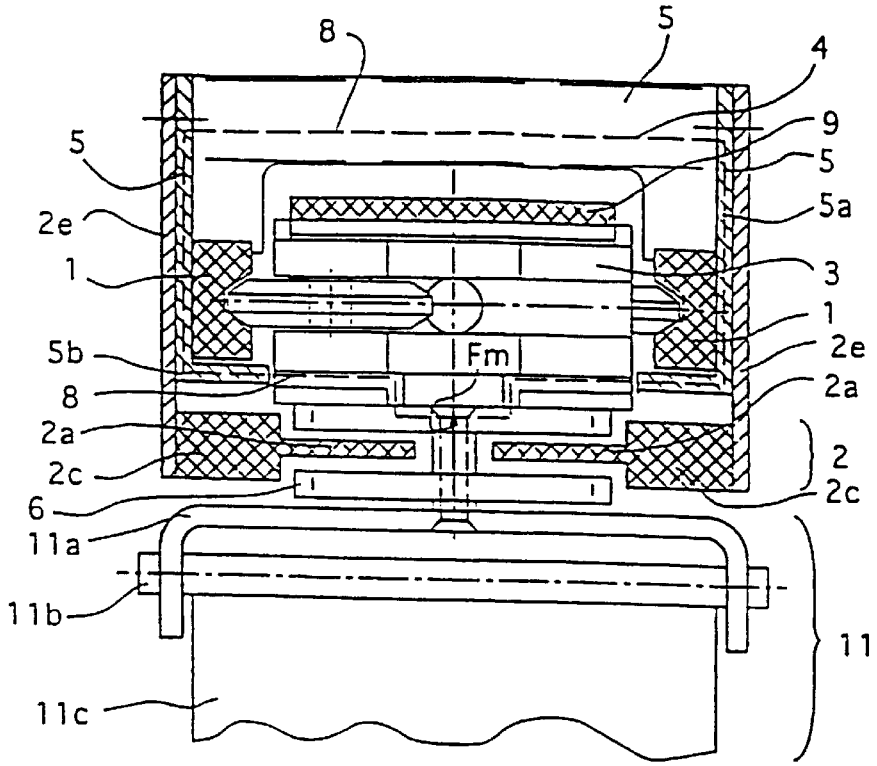
Figure 8:
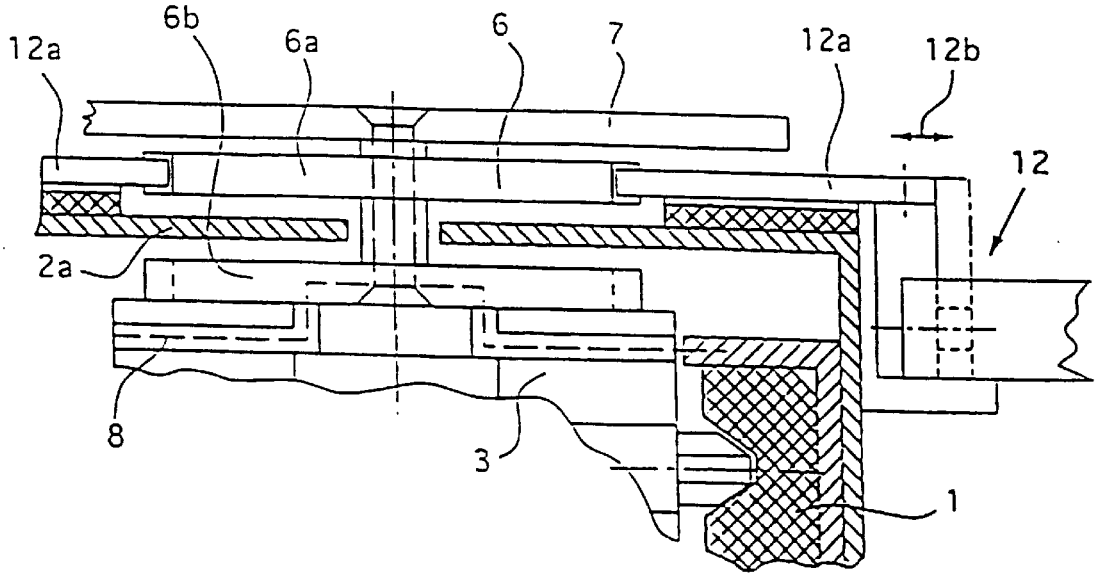
Figure 10:
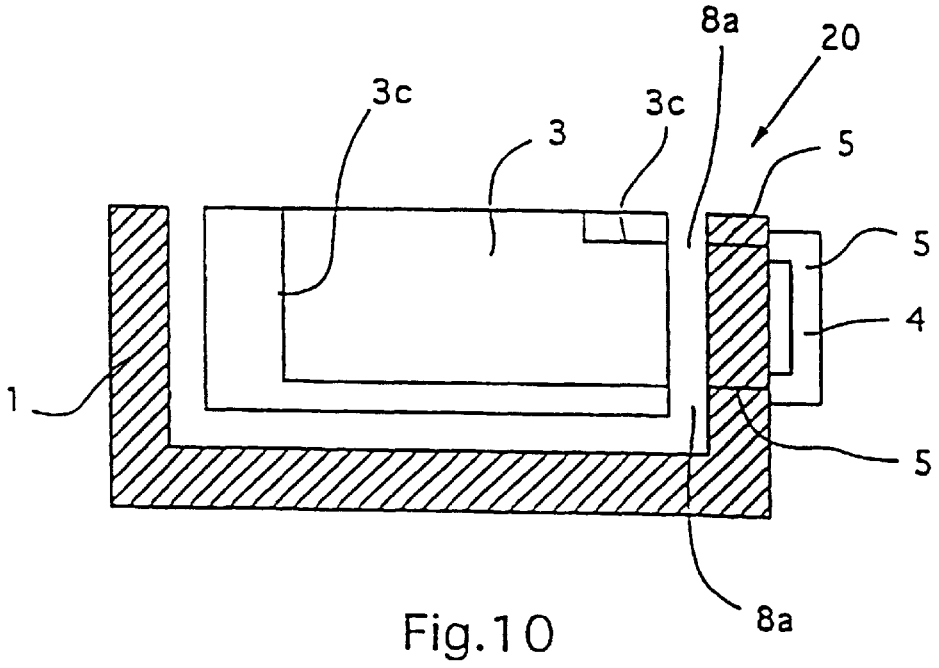
Figure 11:
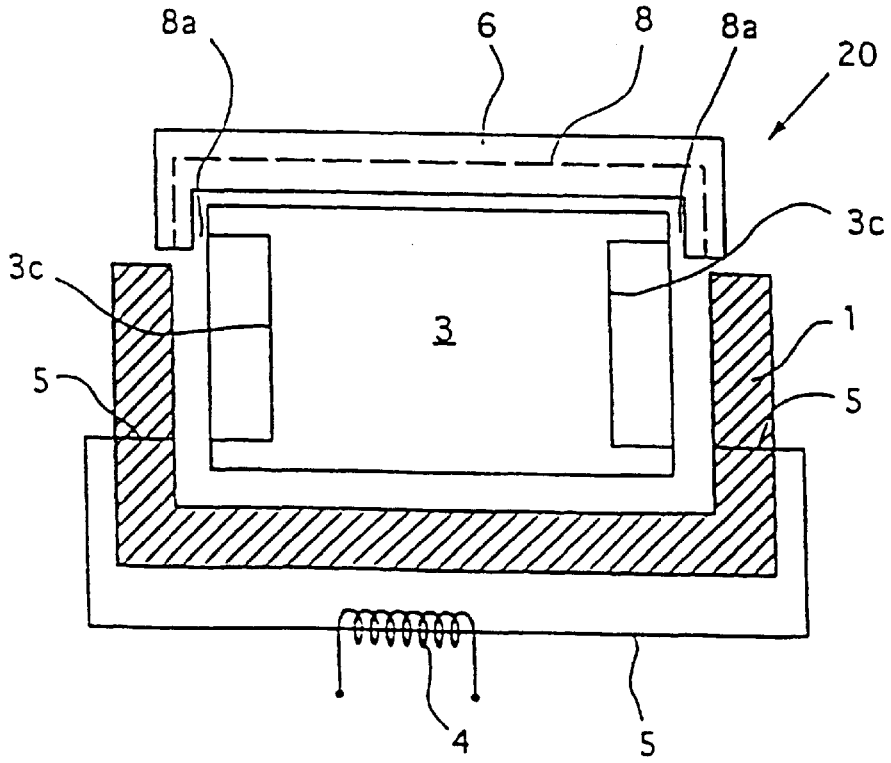

FIG. 5*a* shows a longitudinal view of a transport means;

FIG. 5*b* shows a top view of the transport means;

FIG. 6 shows a top view of a ferromagnetic article part designed as a slider;

FIG. 7 shows a cross section through a guide rail with a transport means, with a ferromagnetic article part and with a holding means arranged in suspension thereon;

FIG. 8 shows a cross section through a guide rail with a ferromagnetic article part, with a carrying part and with a holding and releasing device;

FIG. 9 shows a cross section through a further embodiment of a guide rail with a transport means;

FIG. 10 shows diagrammatically a further exemplary embodiment of a guide rail with a transport means;

FIG. 11 shows diagrammatically a further exemplary embodiment of a guide rail with a transport means.

Figure 1:
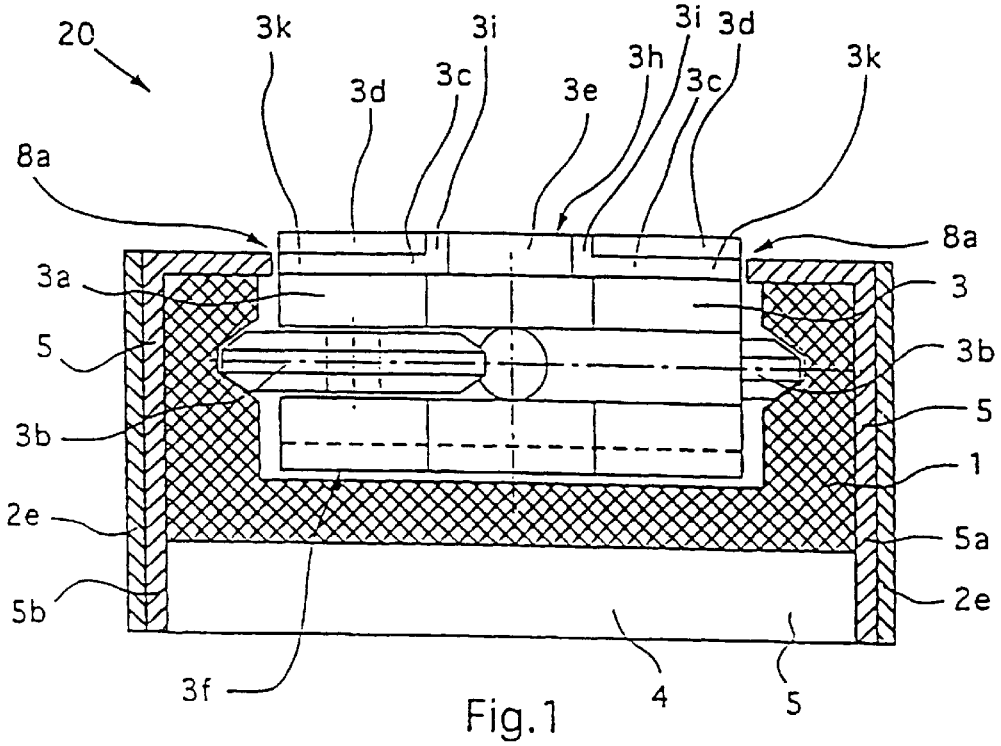
FIG. 1 shows a cross section through a guide rail with a transport means arranged in the guide rail.

FIG. 1 shows a cross section through a conveyor device 20. A unshaped first guide rail 1 has, on the side faces arranged opposite one another, V-shaped grooves which serve for guiding the wheels 3*b* of a transport means 3. The first guide rail 1 defines a conveying direction F, in which the transport means 3 is conveyed, preferably by being driven. Arranged on the first guide rail 1 is a flux-conducting member 5 which consists of two flux-conducting parts 5*a*, 5*b* and of a permanent magnet 4. The two flux-conducting parts 5*a*, 5*b* are L-shaped and are connected fixedly to the guide rail 1. The flux-conducting parts 5*a*, 5*b* have a lower portion which runs in the vertical direction, the permanent magnet 4 being coupled to its ends.

The transport means 3 has a basic body 3*a* composed of a nonferromagnetic material, for example of aluminum or a plastic. Arranged on this basic body 3*a* are two L-shaped ferromagnetic flux-conducting parts 3*c* located at a distance from one another, one end 3*i* of these opening out on the load side 3*h* and the other end 3*k* of these being arranged opposite the flux-conducting members 5*a*, 5*b*, at the same time forming an air gap 8*a*. In order to form a planar load side 3*h*, the two ferromagnetic parts 3*c* are covered with a covering part 3*d* composed of a nonferromagnetic material, and, also, a middle part 3*e* composed of a nonferromagnetic material is arranged between the two ferromagnetic parts 3*c*, so that the two ferromagnetic parts 3*c* open out on the load side 3*h*, without projecting above the surface. The flux-conducting member 5, comprising the magnet 4 and the flux-conducting parts 5*a*, 5*b*, and also the air gap 8*a* and the two flux-conducting parts 3*c* form a magnetic circuit 8.

Figure 2:
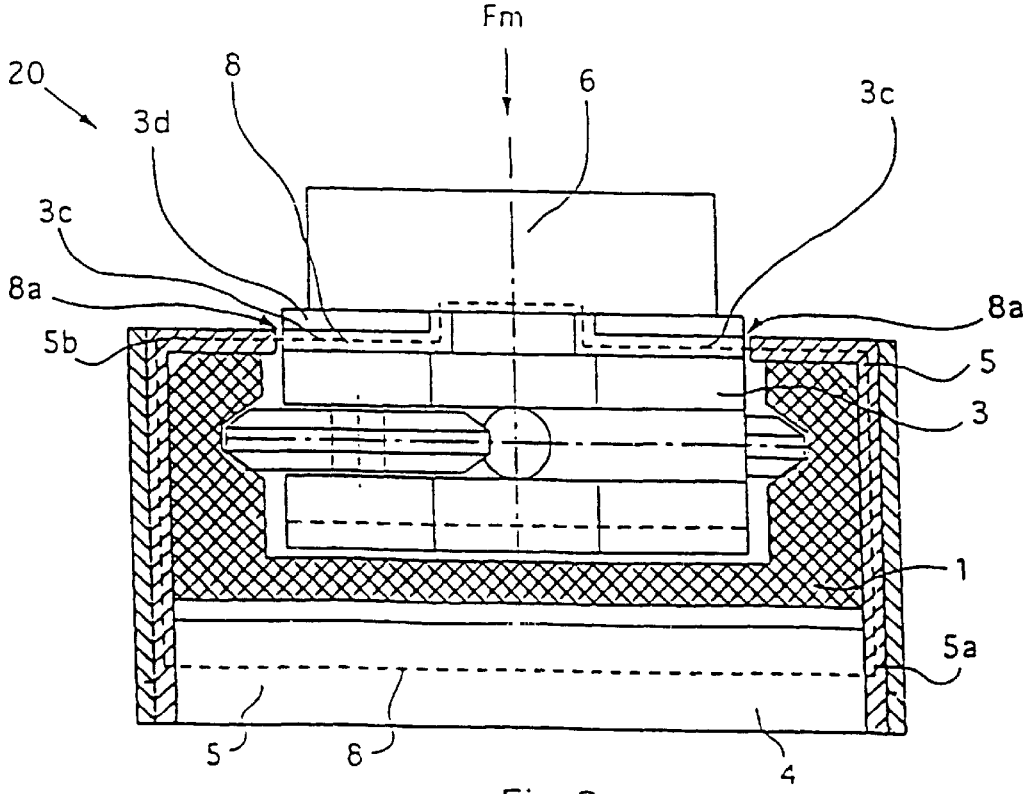
FIG. 2 shows a further cross section through a guide rail with a transport means and with a ferromagnetic part bearing on the load side.

FIG. 2 shows a conveyor device 20 with a ferromagnetic body which bears on the load side 3*h* and is designed as an article part 6 and which closes the magnetic flux circuit 8, so that a magnetically generated attractive force Fm is exerted on the article part 6 by the transport means 3. Articles 6 of any desired shape may be arranged on the surface 3*h* of the transport means 3 and transported, coupled firmly to the carriage 3 via magnetically acting forces. The conveyor device 20 according to the invention thus makes it possible to convey an article in the conveying direction F of a guide rail 1, whilst the article 6 can be separated from the transport means 3 or connected to the transport means 3 at any time or at any predeterminable location.

In the exemplary embodiment according to FIG. 2, the magnetic circuit 8 is arranged to run in such a way that the flux lines run in the air gap 8*a* perpendicularly to the generated magnetic force Fm. The advantage of this arrangement is that the magnetic force Fm is generated between the carriage 3 and the article part 6, so that the wheels 3*b* do not experience any direction load due to the force Fm. In an advantageous embodiment, the flux-conducting parts 5*a* 5*b* of the flux member 5 are designed to run parallel in the conveying direction F in the region of the air gap 8, so that, for a transport means 3, the sum of the width of the two air gaps 8*a* remains constant, even when the transport means a moves back and forth slightly in the horizontal direction on account of existing inaccuracies.

In an advantageous embodiment, the load side 3*h* has a part surface with a good grip, in order to exert additional static friction on the article part 6.

Figure 3:
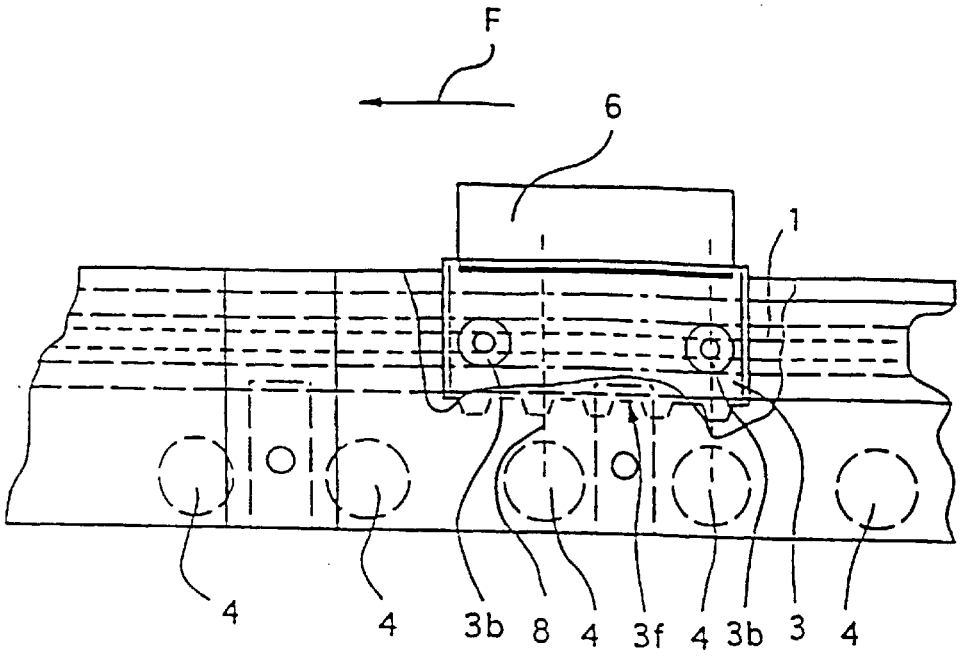
FIG. 3 shows a side view of a guide rail with a transport means designed as a sliding body.

The side view illustrated in FIG. 3 shows a transport means 3 which has, on both sides, two sliding bodies 3*b* which are located at a distance from one another in the conveying direction F and which are mounted slideably in the first guide rail 1. A ferromagnetic article part 6 is connected to the transport means 3 via magnetically acting forces. The magnets 4 are arranged at a distance from one another in the conveying direction F, so that a magnetic circuit 8 is constantly formed in the conveying direction F and therefore a magnetic force Fm is constantly generated by the transport means 3 on the body 6 in the conveying direction F.

Figure 4:
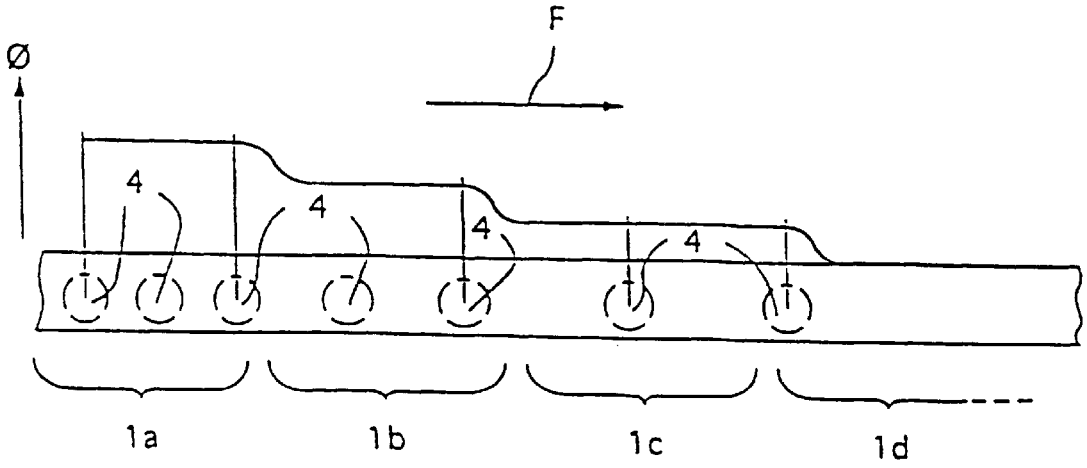
FIG. 4 shows a side view of magnets arranged at a distance from one another in the conveying direction.

FIG. 4 shows magnets 4 which are arranged at different distances from one another in the conveying direction F of the first guide rail 1. FIG. 4 also shows the magnetic flux $\phi$ as a function of the rail length, in a first rail portion 1*a* three magnets 4 being arranged, which generate a relatively high magnetic flux $\phi$ , and, in a subsequent rail portion 1*b*, the three magnets 4 being arranged at a greater distance from one another, so that, as compared with the rail portion 1*a*, a lower magnetic flux $\phi$ is obtained. The magnets 4 are at an even further distance from one another in the rail portion 1*c*, so that there is a further reduction in the magnetic flux $\phi$. There are no more magnets 4 in the rail portion 1*d*. It would likewise be possible for no flux-conducting member 5 to be arranged in the rail portion 1*d*, so that there is no magnetic flux $\phi$. The illustration according to FIG. 4 shows how the magnetic flux $\phi$ can be varied as a function of the location along the first guide rail 1. It would be possible, for example, to provide for releasing the ferromagnetic article part 6 from the transport means 3 in the rail portion 1*c* or 1*d*, in which case the magnetic holding force Fm is reduced in steps in the rail portion 1*a*, 1*b*, 1*c* preceding the rail portion 1*d*. The magnets 4 may be designed as permanent magnets or else as electromagnets, in particular also as those which make it possible to activate and set the magnetic flux $\phi$.

FIG. 5*a* shows a longitudinal view and FIG. 5*b* a top view of the transport means 3, the end face of which is illustrated in FIGS. 1 and 2. The transport means 3 has a parallelepipedic basic body 3*a* composed of a nonferromagnetic material. Recesses for receiving the wheels 3*b* are provided within the basic body. Above the basic body 3*a* are arranged two L-shaped ferromagnetic flux-conducting parts 3*c* arranged at a distance from one another. As is apparent from FIG. 5*b*, the two flux-conducting parts 3*c* arranged at a distance from one another run parallel to the conveying direction F on the surface of the load side 3*h*.

FIG. 6, shows a top view of a ferromagnetic article part 6 designed as a rail-guided slider, the rail parts 2*a*, a gap 2*b* and a second guide rail 2 which has guide parts 2*c* with inner faces 2*d* also being illustrated.

FIG. 7 shows a cross section through a first guide rail 1 and a second guide rail 2. Below the first guide rail 1 is arranged the second guide rail 2 which is designed to run parallel to the first guide rail 1. This second guide rail 2 comprises two rail parts 2*a* which are L-shaped and one leg of which is designed as a side part 2*e* connected fixedly to the flux-conducting part 5*a*, 5*b*. The rail part 2*a* with the side part 2*e* is manufactured from a nonferromagnetic material, for example from aluminum or a plastic. Between the two rail parts 2*a* there is a gap 2*b* which serves for guiding the slider 6. A guide part 2*c* with an inner face 2*d* is arranged on both sides of the upper face of the rail part 2*a*, the inner faces 2*d* serving for guiding the slider 6 or the sliding body 6*a* in the lateral direction. In the exemplary embodiment according to FIG. 7, the second guide rail 2 is designed in such a way that in the state illustrated, in which the slider 6 is connected fixedly to the transport means 3 by means of the magnetically acting forces, there is no mutual contact between the slider 6 and the second guide rail 2, so that the second guide rail would not be necessary. For this purpose, a sufficiently large play must be provided between the slider 6 and the second guide rail 2. The slider 6 is arranged in suspension on the bottom of the transport means 3 and is connected to a holding means 11 which comprises a stirrup 11*a*, a joint 11*b* and two tongues 11*c*. The magnetic force Fm generated on the slider 6 by the transport means 3 via the magnetic circuit 8 is sufficient to connect the holding means 11 securely to the transport means 3. This embodiment is suitable, in particular, for the conveyance of light sheet-like printing products.

FIG. 8 shows a further cross section through the first guide rail 1, with a releasing and holding device 12 which is arranged laterally relative to the guide rail 1 and which has, on each of the two sides of the rail 1, a retaining finger 12*a* moveable in the direction of movement 12*b* and acting on the slider 6. This releasing and holding device 12 makes it possible to detach the ferromagnetic article part 6 from the transport means 3 or to hold or release the transport means 3, together with the article part 6, in a controllable manner. Moreover, the releasing and holding device 12 makes it possible to form a build-up or article parts 6 located one behind the other, to buffer the article parts 6 and to release them in a controlled manner, for example, individually or in groups.

FIG. 9 shows a further exemplary embodiment of a guide rail 1 with a transport means 3. The guide rail 1 consists of two parts which are arranged in a U-shaped manner and between which is arranged the flux-conducting member 5 comprising the magnet 4 and the flux-conducting parts 5*a*, 5*b*. A transport means 3 designed as a carriage has a basic body 3*a* with two axles 3*g* located at a distance from one another in the conveying direction F and also with four wheels 3*b*, the wheels 3*b* being guided in the conveying direction F and held securely on both sides in the U-shaped part of the guide rail 1. On both sides of the basic body 3*a* are arranged flux-conducting parts 3*c* running in a vertical direction in relation to the conveying direction F, these flux-conducting parts 3*c* and the flux-conducting parts 5*a*, 5*b* being arranged in adaptation to one another in such a way that an air gap 8*a* occurs between these parts 3*c*; 5*a*, 5*b* and a magnetic circuit 8 is formed, which opens onto the load side 3*h* of the transport means 3, so that the ferromagnetic article part 6 is held on this load side 3*h* by means of the magnetically generated attractive force Fm. The transport means 3 has at the bottom an engagement face 3*f* (see FIG. 5*a*), into which, for example, a toothed belt 9 (see FIG. 7) engages, in order to drive the transport means 3 in the conveying direction F. The first and second guide rails 1, 2 are produced in one piece, in that the rail parts 2*a* of the second guide rail 2 and the first guide rail 1 form a common part which consists, for example, of plastic.

FIG. 10 shows diagrammatically a further exemplary embodiment of a conveyor device 20 with the transport means 3 and with the first guide rail 1, the wheels of the transport means 3 not being illustrated. This embodiment has a flux-conducting member 5 comprising a magnet 4 which is arranged on the right side of the guide rail 1. The two flux-conducting parts 3*c* arranged in the transport means 3 are arranged to run in such a way that the two air gaps 8*a* on the right side of the transport means 3 are arranged opposite the flux-conducting member 5.

FIG. 11 shows diagrammatically a further exemplary embodiment of a conveyor device 20 with the transport means 3 and with the first guide rail 1, the wheels of the transport means 3 not being illustrated. This embodiment has a slightly U-shaped article part 6, so that the two lateral legs of the article part 6 bear on the two side faces of the transport means and the article part 6 is secured against rotation. The flux-conducting parts 3*c* likewise open at one end onto the side faces of the transport means 3, in order to form a magnetic circuit with the article part 6. The flux-conducting parts 3*c* likewise open at the other end onto the side face of the transport means 3, the flux-conducting member 5 being arranged opposite them in the guide rail 1, in order to form a magnetic circuit 8. In the exemplary embodiment illustrated, a coil is wound around the flux-conducting member 5, the coil through which current flows acting as an electromagnet 4 which generates the magnetic flux in the magnetic circuit 8.

What is claimed is:

1. Conveyor device (20), comprising a guide rail (1) and at least one transport means (3) guided on the guide rail (1) and driven in a conveying direction (F), characterized in that a ferromagnetic flux-conducting member (5) arranged fixedly relative to the guide rail (1) comprises a magnet (4), in that the transport means (3) has in each case two ferromagnetic flux-conducting parts (3*c*) which are located at a distance from one another and which are designed and arranged in such a way that a magnetic circuit (8) is formed between a ferromagnetic article part (6) bearing releasably on the transport means (3), and also in such a way that the flux-conducting parts (3*c*) and the flux-conducting member (5) are arranged relative to one another, that an air gap (8*a*) is formed and that the two flux-conducting parts (3*c*) form with the flux-conducting member (5) a magnetic circuit (8), in order to exert a magnetically generated attractive force (Fm) on the article part (6).

2. Conveyor device (20) according to claim 1, characterized in that the transport means (3) have a load side (3*h*), and in that the one end (3*i*) of the flux-conducting parts (3*c*) opens in each case onto the load side (3*h*).

3. Conveyor device (20) according to claim 1 or 2 characterized in that the magnet (4) is designed as a permanent magnet or an electromagnet, the electromagnet being formed at least by a coil arranged on the flux-conducting member (5), and the electromagnet making it possible, in particular, to generate an adjustable magnetic flux.

4. Conveyor device (20) according to claim 1 or 2 characterized in that a plurality of magnets (4) are arranged at a distance from one another in the conveying direction (F).

5. Conveyor device (20) according to claim 1 or 2, characterized in that the flux-conducting member (5) are designed to extend in the conveying direction (F).

6. Conveyor device (20) according to claim 1 or 2, preceding claims, characterized in that the flux-conducting parts (3*c*) and the flux-conducting members (5) are designed and arranged relative to one another in such a way that the magnetic flux lines in the air gap (8*a*) run approximately perpendicularly to the magnetic force (Fm), and in that the flux-conducting member (5) runs, in particular, parallel in the conveying direction (F), so that the sum of the air gaps (8*a*) occurring between the flux-conducting parts (3*c*) and the flux-conducting member (5) remains constant during conveyance in the conveying direction (F).

7. Conveyor device (20) according to claim 1 or 2, characterized in that the flux-conducting parts (3*c*) -and the flux-conducting member (5) are designed and arranged relative to one another in such a way that the magnetic flux lines in the air gap (8*a*) run approximately parallel to the magnetic force (Fm).

8. Conveyor device (20) according to claim 1 or 2, characterized in that the transport means (3) consists, with the exception of the flux-conducting parts (3*c*), of a nonferromagnetic metal or a plastic.

9. Conveyor device (20) according to claim 1 or 2, characterized in that the load side (3*h*) of the transport means (3) has a part surface designed with a good grip, in order to exert additional static friction on the article part (6).

10. Conveyor device (20) according to claim 1 or 2, characterized in that the article part (6) is designed as a rail-guided slider which is guided by a second guide rail (2) running parallel to the first guide rail (1) in the conveying direction (F), and in that a carrier part (7) or a holding means (11) is connected fixedly to the slider.

11. Conveyor device (20) according to claim 10, characterized in that the play between the slider (6) and the second guide rail (2) is dimensioned in such a way that a slider (6) coupled to the transport means (3) via magnetically acting forces is held without contact with the second guide rail (2).

12. Conveyor device (20) according to claim 1 or 2, characterized by a holding and releasing device (12) acting on the article part (6), in order to detach the ferromagnetic article part (6) from the transport means (3) or to hold or release the transport means (3), together with the article part (6), in a controllable manner.

13. Conveyor system, in particular for printing products, comprising a conveyor device according to claim 1 or 2.

14. Guide rail (1) or transport means (3) for a conveyor device according to claim 1 to 2.

* * * * *